US009131579B2

(12) United States Patent
Lin

(10) Patent No.: US 9,131,579 B2
(45) Date of Patent: Sep. 8, 2015

(54) DRIVING APPARATUS FOR LED CHIPS OF DIFFERENT SPECIFICATIONS

(71) Applicants: HEP TECH CO., LTD., Taichung (TW); Ming-Feng Lin, Taichung (TW)

(72) Inventor: Ming-Feng Lin, Taichung (TW)

(73) Assignees: HEP TECH CO., LTD., Taichung (TW); Ming-Feng Lin, Taichung (TW)

( * ) Notice: Subject to any disclaimer, the term of this patent is extended or adjusted under 35 U.S.C. 154(b) by 0 days.

(21) Appl. No.: 14/204,972

(22) Filed: Mar. 11, 2014

(65) Prior Publication Data

US 2014/0292228 A1 Oct. 2, 2014

(30) Foreign Application Priority Data

Mar. 27, 2013 (TW) ..... 102205680 U

(51) Int. Cl.
*H05B 37/02* (2006.01)
*H05B 33/08* (2006.01)

(52) U.S. Cl.
CPC ..... *H05B 33/0851* (2013.01); *H05B 33/0848* (2013.01)

(58) Field of Classification Search
CPC ..... H05B 33/0809; H05B 33/0833; H05B 37/02; H05B 39/02; H05B 39/04
USPC ..... 315/185 R, 186, 187, 192, 224, 291, 315/307, 308
See application file for complete search history.

(56) References Cited

U.S. PATENT DOCUMENTS

2005/0231133 A1* 10/2005 Lys ..... 315/291
2012/0306389 A1* 12/2012 Shteynberg et al. ..... 315/186
2013/0320862 A1* 12/2013 Campbell et al. ..... 315/152

* cited by examiner

*Primary Examiner* — Tung X Le
(74) *Attorney, Agent, or Firm* — WPAT, P.C.; Justin King

(57) ABSTRACT

A driving apparatus for LED chips includes: a driving unit, a voltage measuring unit, and a feedback control module. The driving unit provides a driving voltage and a driving current to a LED chip; the voltage measuring unit measures the driving voltage; the feedback control module is built-in with a default power; According to the driving voltage measured by the voltage measuring unit and the default power, the feedback control module controls the driving unit to maintain the driving current at a working current, wherein the working current matches the rated current of the LED chip. Whereby, the driving apparatus could drive LED chips of different specifications.

12 Claims, 5 Drawing Sheets

DRIVING APPARATUS FOR LED CHIPS OF DIFFERENT SPECIFICATIONS

The current application claims a foreign priority to the patent application of Taiwan No. 102205680 filed on Mar. 27, 2013.

BACKGROUND OF THE INVENTION

1. Technical Field

The present invention relates generally to driving LED, and more particularly to a driving apparatus for LED chips of different specifications.

2. Description of Related Art

Typically, a LED illuminating device includes a LED chip and a driving apparatus, wherein the driving apparatus provides power to drive the LED chip. There are various types of LED chips in the current market, and LED chips of different specifications may individually have different rated voltages and rated currents, even for those of the same power. Conventionally, a driving apparatus merely fits one specific specification, and therefore could drive only one type of LED chips. Thus, since there are many types of LED chips having different specifications, the inventory pressure of driving apparatuses is high for manufacturers. And given that manufacturers have to produce driving apparatuses to drive each type of LED chips, the quantities of each type of driving apparatuses is limited, and therefore the price and the manufacturing cost is unlikely to be lowered. If a driving apparatus for LED chips of different specifications can be provided, the inventory pressure and the manufacturing cost of driving apparatuses will be effectively reduced.

BRIEF SUMMARY OF THE INVENTION

In view of the above, the primary objective of the present invention is to provide a driving apparatus for LED chips, wherein the LED chips have different specifications.

The present invention provides a driving apparatus for LED chips of different specifications, wherein a LED chip is connected to the driving apparatus. The driving apparatus includes a driving unit, a voltage measuring unit, and a feedback control module. The driving unit is electrically connected to a power source and the LED chip, wherein the driving unit receives power of the power source, and provides a driving voltage and a driving current to the LED chip; The voltage measuring unit is electrically connected to the driving unit, wherein the voltage measuring unit measures the driving voltage; the feedback control module is electrically connected to the voltage measuring unit and the driving unit, wherein the feedback control module is built-in with a default power. According to the driving voltage measured by the voltage measuring unit and the default power, the feedback control module controls the driving unit to make the driving current match a rated current of the LED chip.

The present invention further provides another driving apparatus, which includes a driving unit, a voltage measuring unit, and a feedback control module. The driving unit is electrically connected to a power source and the LED chip, wherein the driving unit receives power of the power source, and provides a driving voltage and a driving current to the LED chip; the voltage measuring unit is electrically connected to the driving unit, wherein the voltage measuring unit measures the driving voltage; the feedback control module electrically connected to the voltage measuring unit and the driving unit, wherein the feedback control module is built-in with a plurality of reference voltages. According to the reference voltage corresponding to the driving voltage measured by the voltage measuring unit, the feedback control module controls the driving unit to make the driving current match the rated current of the LED chip.

Whereby, the driving apparatuses could be applied to drive LED chips of different specifications, which effectively improve the inconvenience of the conventional driving apparatus that it could be only compatible with LED chips of one specific specification.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
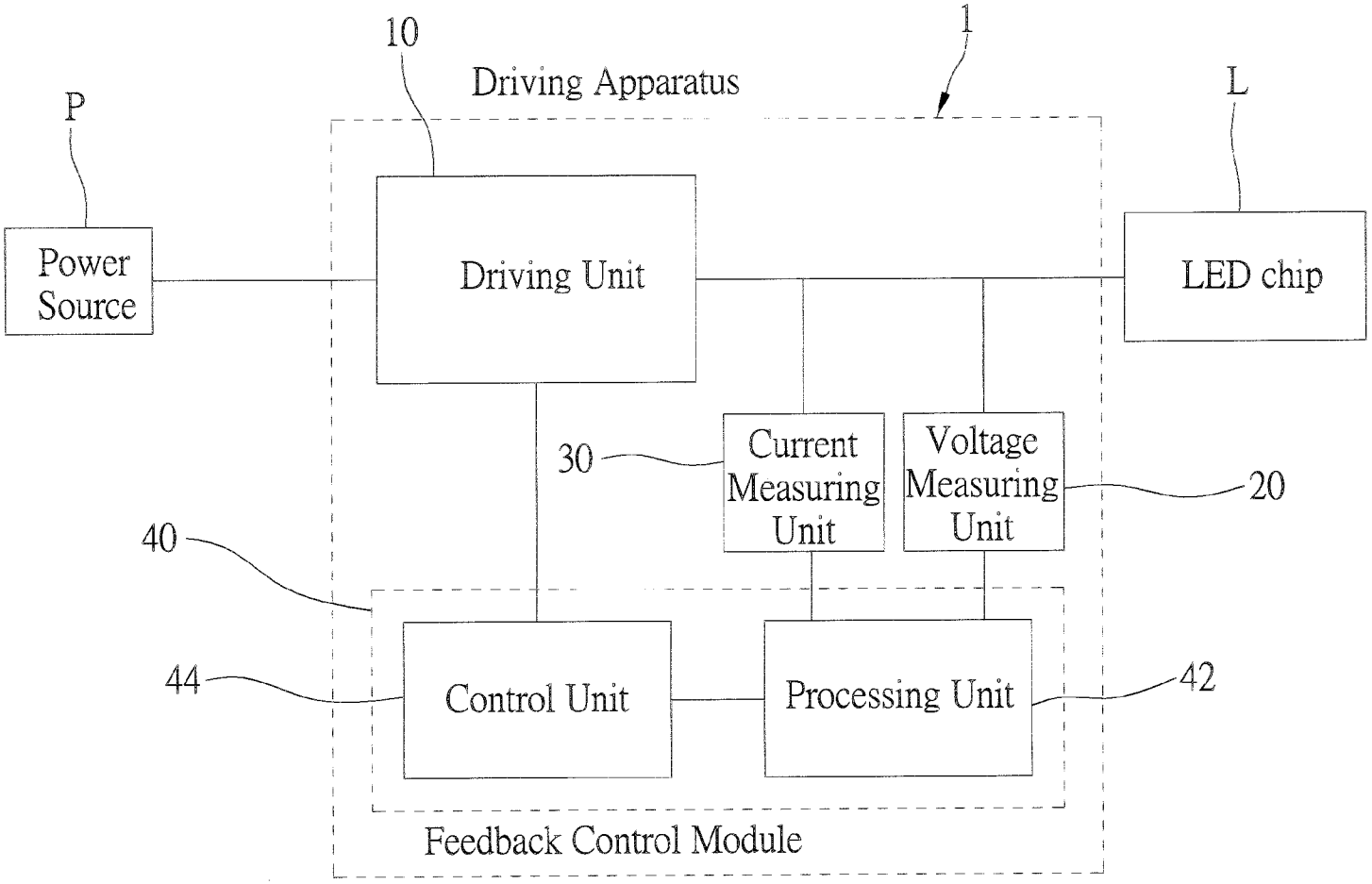
FIG. 1 is a block diagram of the driving apparatus of a first preferred embodiment of the present invention.

As shown in FIG. 1, in the first embodiment of the present invention, the driving apparatus 1 for driving LED (Light-Emitting Diode) chips with different specifications includes a driving unit 10, a voltage measuring unit 20, a current measuring unit 30, and a feedback control module 40.

The driving unit 10 is electrically connected to a power source P and a LED chip L, wherein the driving unit 10 receives power from the power source P, and provides a driving voltage and a driving current to the LED chip L. The driving unit 10 is controllable to regulate the driving voltage and the driving current. In practice, the design of the driving unit 10 could be based on PWM, half-bridge, buck, or boost circuits, and the LED chip L could be selected from LED chips of the same rated power, which respectively have different rated voltages and rated currents.

The voltage measuring unit 20 is electrically connected to the driving unit 10, wherein the voltage measuring unit 20 measures the driving voltage provided by the driving unit 10. The current measuring unit 30 is electrically connected to the driving unit 10, wherein the current measuring unit 30 measures the driving current provided by the driving unit 10.

The feedback control module 40 includes a processing unit 42 and a control unit 44, which are electrically connected to each other. The processing unit 42 is electrically connected to the voltage measuring unit 20 and the current measuring unit 30, and the control unit 44 is electrically connected to the driving unit 10. The processing unit 42 is stored with a default power, which is the same or approximately the same with a rated power of the LED chip L connected to the driving unit 10. Preferably, the rated power of the LED chip L is between 90% and 110% of the default power.

The processing unit 42 obtains a working current for the LED chip L according to the driving voltage measured by the voltage measuring unit 20 and the default power, wherein the working current matches the rated current of the connected LED chip L. The processing unit 42 transmits a current control signal to the driving unit 10 through the control unit 44 to maintain the driving current the same as the working current.

In the preferred embodiment, the processing unit 42 transmits the current control signal to the driving unit 10 through the control unit 44 to make the driving current provided by the driving unit 10 increase gradually from an initial current which is less than the working current. At the same time, the processing unit 42 measures the driving voltage and the driving current through the voltage measuring unit 20 and the current measuring unit 30, and calculates a product of the driving voltage and the driving current (i.e., a driving power applied to the LED chip L). It can be easily understood that the driving voltage provided to the LED chip L increases along with the driving current provided by the driving unit 10, and therefore the driving power applied on the LED chip L increases as well. Furthermore, the driving current increases till the driving power applied to the LED chip L equals the default power, and the driving current at this time point is the working current. As a result, the working current required by the LED chip L could be obtained. In practice, the working current could be obtained with methods other than calculation. For example, voltages of multiple LEDs while operating with the initial current could be measured in advance, and then the correspondences of the measured voltages and the LED chips could be saved in a database. Whereby, after the LED chip L being connected to the driving unit 10, the voltage of the LED chip L while operating with the initial current could be measured, and the working current could be easily retrieved from the database according to the measured voltage.

The processing unit 42 transmits the current control signal to the driving unit 10 through the control unit 44 to maintain the driving current the same as the working current for the LED chip L, and since the driving power provided to the LED chip L matches the default power, the LED chip L therefore has a constant power. In other words, the product of the driving voltage and the driving current is maintained as the default power.

According to the aforementioned description, the driving apparatus 1 could automatically obtain the working current which is required for maintaining the connected LED chip L to have the default power. Therefore, even the LED chip L is replaced by another LED chip of different rated voltage and rated current, as long as its rated power is the same or approximately the same as the default power, the driving apparatus 1 is compatible with it too. Therefore, the driving apparatus 1 is not merely limited to drive LED chips having a specific rated voltage and a specific rated current, the inconvenience of the conventional driving apparatus, which could be applied to drive LED chips of a specific specification, is effectively improved.

Figure 2:
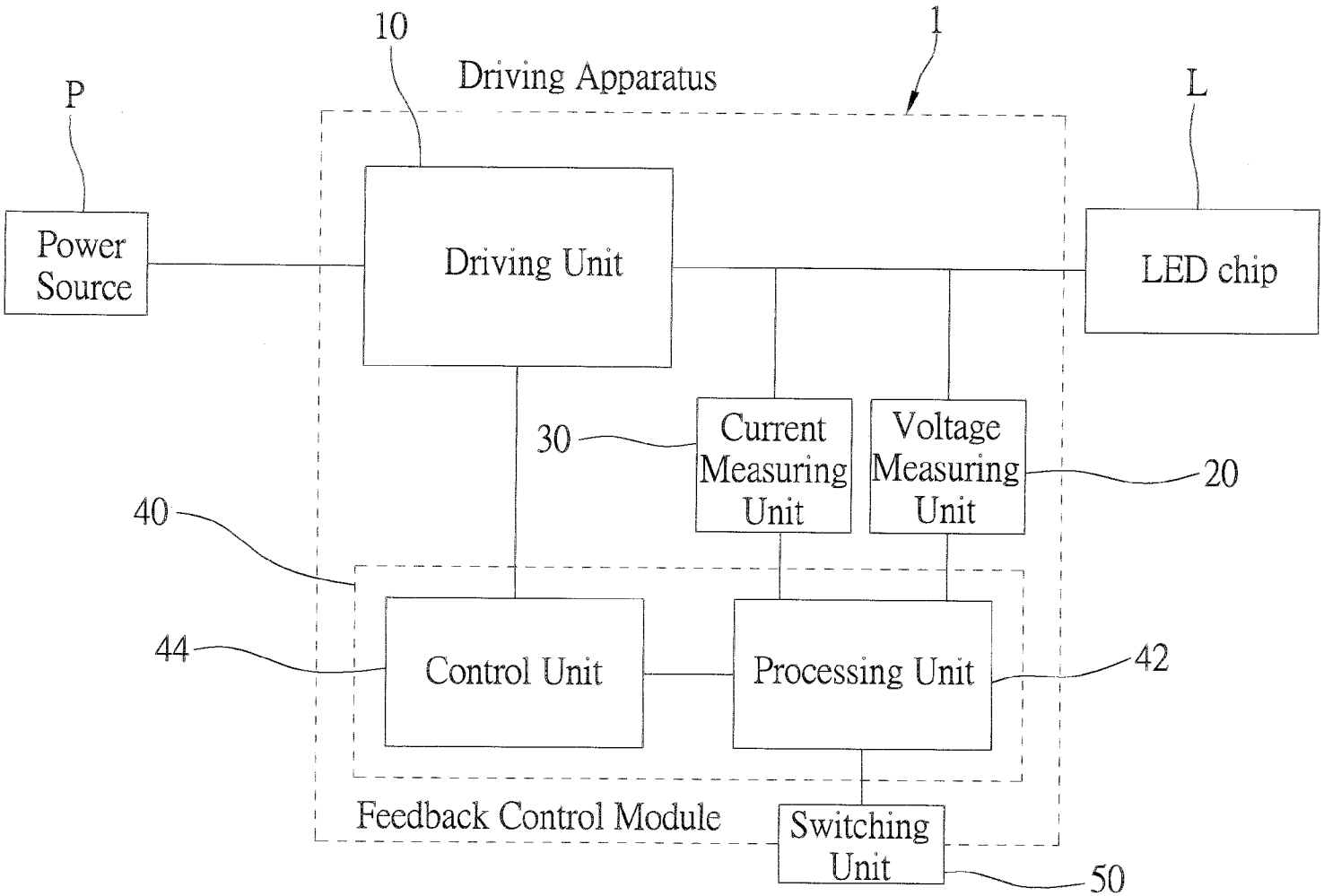
FIG. 2 is a block diagram of the driving apparatus of a second preferred embodiment of the present invention.

As shown in FIG. 2, in the second embodiment of the present invention, the driving apparatus 1 further includes a switching unit 50 electrically connected to the processing unit 42, wherein the processing unit 42 is stored with a plurality of powers, and the switching unit 50 selects one of the powers as the default power. Whereby, the driving apparatus 1 is compatible to drive LED chips with different rated powers. In practice, the design of the switching unit 50 could be based on a switch, for which users could set the default power simply by switching the switch.

Figure 3:
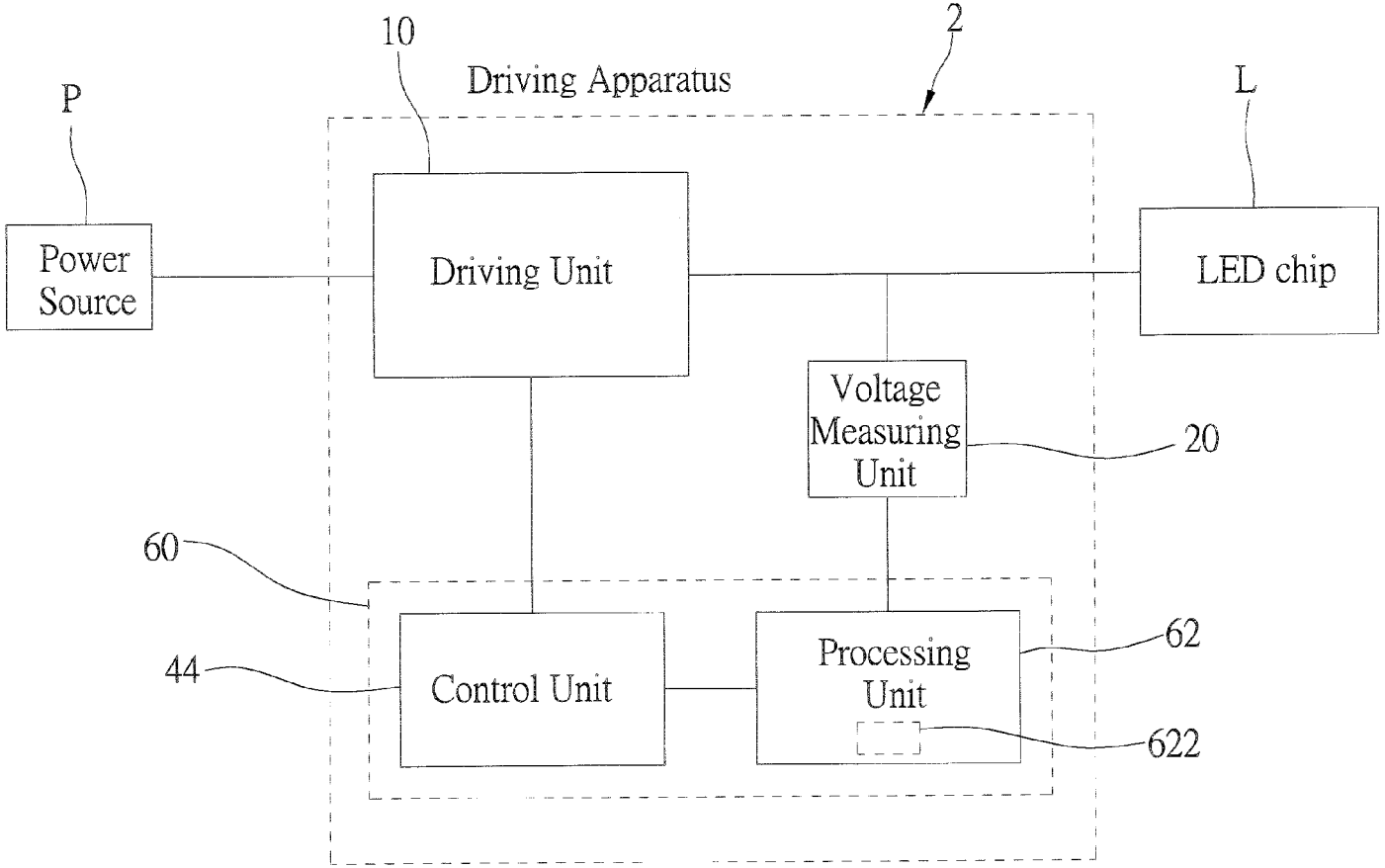
FIG. 3 is a block diagram of the driving apparatus of a third preferred embodiment of the present invention.

As shown in FIG. 3, in the third embodiment of the present invention, a driving apparatus 2 is basically the same as the two aforementioned embodiments, except that a processing unit 62 of a feedback control module 60 has a memory 622. There is a database established in advance in the memory 622, and the database saves a plurality of reference voltages and a plurality of current parameters, wherein each of the reference voltages corresponds to one of the current parameters. The processing unit 62 controls the control unit 44 with one of the current parameters to transmit a corresponding current control signal to the driving unit 10 to maintain the driving current provided by the driving unit 10 as a specific setting current.

Here we provide five LED chips with different specifications to the driving apparatus 2 as examples for explanation, wherein the rated voltages and the rated currents of the LED chips are: 45V/500 mA, 38V/700 mA, 34V/900 mA, 20V/1500 mA, and 14V/1400 mA, respectively.

First of all, the voltage of each LED chip while operating with a testing current is measured, wherein the testing current is less than the rated currents of the LED chips. The corresponding voltage of each LED chip while operating with the testing current is defined as one of the reference voltages; in other words, the five different types of LED chips respectively correspond to five of the reference voltages. Next, the current parameters correspond to the rated currents are retrieved, and the correspondences between the reference voltages and the current parameters are saved in the database. Whereby, each reference voltage corresponds to one of the setting current provided by the driving unit 10, and each setting current matches one of the rated currents of the 5 types of LED chips.

After connecting one of the LED chips to the driving unit 10 (and the connected LED chip is the LED chip L by definition now), the processing unit 62 transmits the current control signal to the driving unit 10 through the control unit 44 to make the driving current equal the testing current, and the processing unit 62 measures the driving voltage through the voltage measuring unit 20 at the same time. And then, the current parameter which corresponds to the reference voltage corresponding to the measured driving voltage is retrieved from the database.

Figure 4:
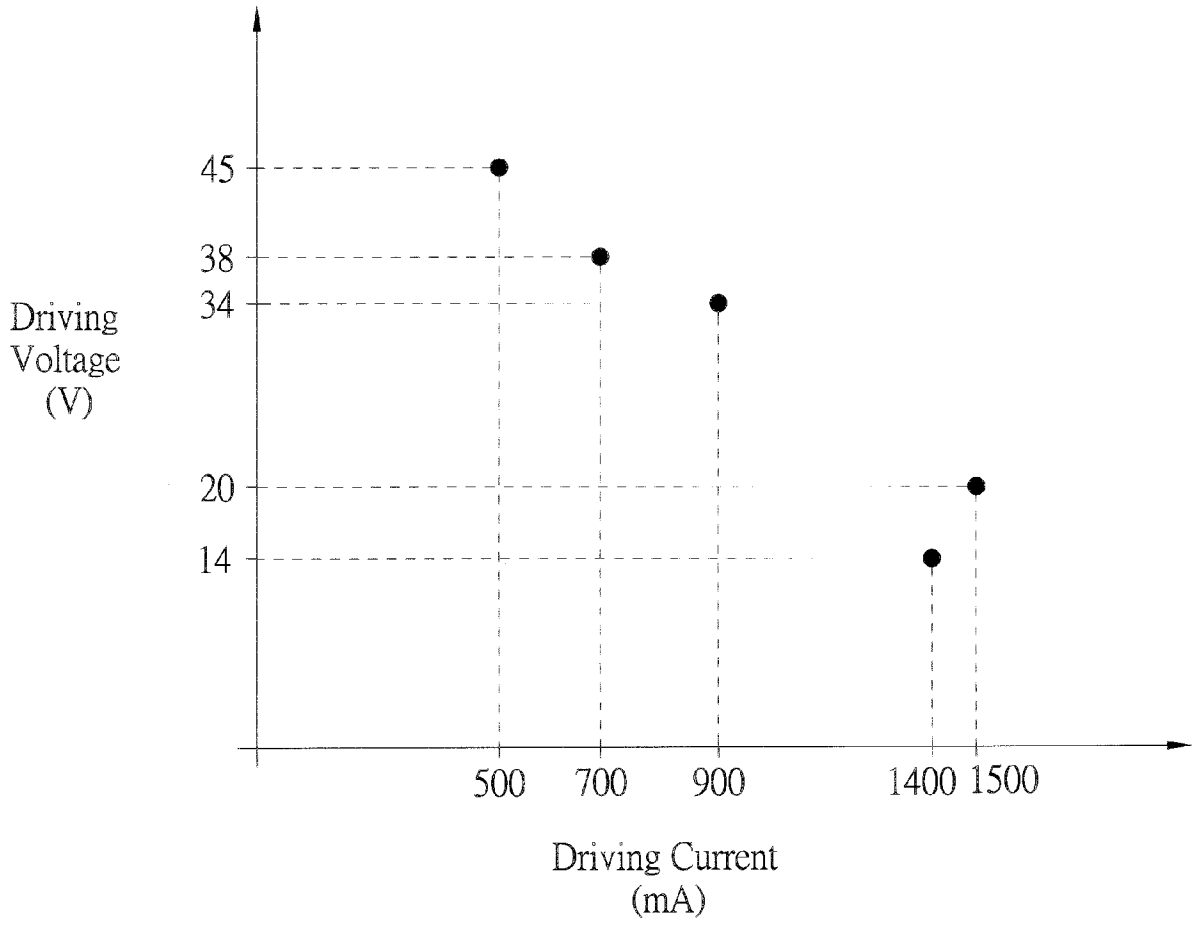
FIG. 4 is a diagram, showing the output characteristics of the third preferred embodiment of the present invention.

After that, the processing unit 62 controls the control unit 44 with the retrieved current parameter to transmit the corresponding current control signal to the driving unit 10, and the driving current is maintained as the corresponding setting current then. Whereby, the rated current required by the LED chip L is provided. In more details, the driving unit 10 automatically regulates the driving voltage according to properties of the connected LED chip L to provide power which matches the specification of the connected LED chip L. As shown in FIG. 4, the driving apparatus 2 is able to provide the required driving current and driving voltage for any one of the five different types of LED chips.

In the third preferred embodiment, each setting current corresponds to one of the reference voltages, and in order to make the driving apparatus 2 further compatible with more types of LED chips, each setting current could respectively corresponds to one reference voltage segment in practice.

The fourth preferred embodiment is in such cases, in which a plurality of reference voltage segments and a plurality of current parameters are saved in the database in advance. Each reference voltage segment corresponds to one of the current parameters, and each reference voltage segments includes multiple reference voltages.

The processing unit 62 controls the driving unit 10 through the control unit 44 to make the driving current as the testing current, and the driving voltage is measured at the same time. According to the reference voltage segment where the measured driving voltage falls in, the current parameter which corresponds to the reference voltage segment is retrieved from the database, and the driving current of the driving unit 10 is maintained as the corresponding setting current in this way. Therefore the rated current required by the LED chip L is provided, and the driving unit 10 automatically regulates the provided driving voltage according to properties of the connected LED chip L to provide power which matches the specification of the connected LED chip L.

Furthermore, in the preferred embodiment, zero voltage is included in one of the reference voltage segments. In other words, if the measured driving voltage is zero, there still is a corresponding setting current. Whereby, once if the connected LED chip L is short, the driving current could be effectively restricted, which prevents the driving unit 10 from being damaged.

Figure 5:
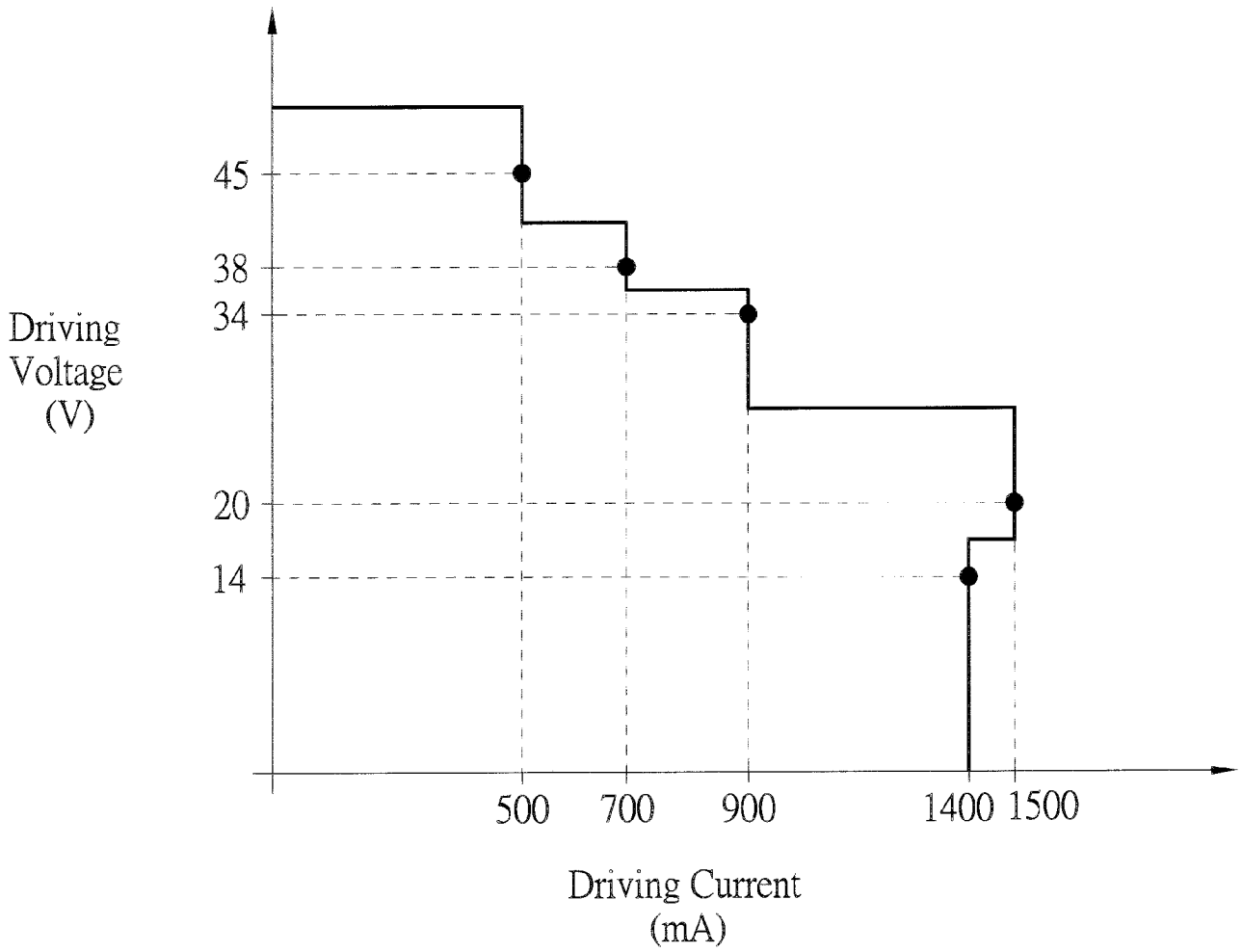
FIG. 5 is a diagram, showing the output characteristics of a fourth preferred embodiment of the present invention.

The output characteristics of the driving apparatus 2 are shown in FIG. 5. For any LED chip, as long as its rated current matches the five current shown in the FIG. 5, and its rated voltage falls into the corresponding voltage segments, then the driving apparatus 2 is compatible to. Therefore, the driving apparatus 2 is capable of driving LED chips of specifications other than those of the five aforementioned LED chips.

The driving apparatus provided in the present invention is able to drive LED chips of different specifications, and is not just limited for any specific one type. As a result, the inconvenience of using the conventional driving apparatus, which could only drive the LED chip of one specific specification, is effectively improved.

It must be pointed out that the embodiments described above are only some preferred embodiments of the present invention. All equivalent structures and methods which employ the concepts disclosed in this specification and the appended claims should fall within the scope of the present invention.

What is claimed is:

1. A driving apparatus for driving LED chips of different specifications, wherein one of the LED chips is connected to the driving apparatus, comprising:

a driving unit electrically connected to a power source and the LED chip, wherein the driving unit receives power of the power source, and provides a driving voltage and a driving current to the LED chip;

a voltage measuring unit electrically connected to the driving unit, wherein the voltage measuring unit measures the driving voltage; and a feedback control module electrically connected to the voltage measuring unit and the driving unit, wherein the feedback control module is stored with a default power to control the driving unit to regulate the driving current to match a rated current of the LED chip according to the driving voltage measured by the voltage measuring unit and the default power.

2. The driving apparatus of claim 1, wherein the feedback control module controls the driving unit to make the driving current increase gradually from an initial current, and measures the driving voltage provided to the LED chip to calculate a product of the driving voltage and the driving current; the driving current is increased till the product equals the default power, and the driving current is maintained then.

3. The driving apparatus of claim 2, further comprises a current measuring unit electrically connected to the driving unit and the feedback control module, wherein the current measuring unit measures the driving current; the feedback control module calculates the product according to the measured driving current and the measured driving voltage.

4. The driving apparatus of claim 1, wherein the rated power of the LED chip connected to the driving unit is between 90% and 110% of the default power.

5. The driving apparatus of claim 1, further comprises a switching unit electrically connected to the feedback control module, wherein the feedback control module is stored with a plurality of powers, and the switching unit selects one of the powers to be the default power.

6. A driving apparatus for driving a plurality of LED chips of different specifications, wherein one of the LED chips is connected to the driving apparatus, comprising:

a driving unit electrically connected to a power source and the LED chip, wherein the driving unit receives power of the power source, and provides a driving voltage and a driving current to the LED chip;

a voltage measuring unit electrically connected to the driving unit, wherein the voltage measuring unit measures the driving voltage; and a feedback control module electrically connected to the voltage measuring unit and the driving unit, wherein the feedback control module is stored with a plurality of reference voltages to control module controls the driving unit to regulate the driving current to match the rated current of the LED chip according to the reference voltage corresponding to the driving voltage measured by the voltage measuring unit.

7. The driving apparatus of claim 6, wherein the reference voltages are segmented into a plurality of reference voltage segments; the reference voltages in the same reference voltage segment correspond to the same driving current provided by the driving unit; according to the reference voltage segment where the reference voltage which corresponds to the driving voltage measured by the voltage measuring unit belongs to, the feedback control module controls the driving unit to make the driving current match the rated current of the LED chip.

8. The driving apparatus of claim 7, wherein zero voltage is included in one of the reference voltage segments.

9. The driving apparatus of claim 7, wherein the feedback control module controls the driving unit to make the driving current be a fixed testing current, and measures the driving voltage provided to the LED chip.

10. The driving apparatus of claim 9, wherein the testing current is less than the rated current of the LED chip.

11. The driving apparatus of claim 6, wherein the feedback control module controls the driving unit to make the driving current be a fixed testing current, and measures the driving voltage provided to the LED chip.

12. The driving apparatus of claim 11, wherein the testing current is less than the rated current of the LED chip.

* * * * *